US010297904B2

(12) United States Patent
Yu et al.

(10) Patent No.: US 10,297,904 B2
(45) Date of Patent: May 21, 2019

(54) ANTENNA AND ANTENNA SYSTEM APPLIED IN METAL COVER

(71) Applicant: SPEED WIRELESS TECHNOLOGY INC., San Jose, CA (US)

(72) Inventors: Bin Yu, Suzhou (CN); Xitong Wu, Suzhou (CN); Kang Yang, Suzhou (CN)

(73) Assignees: SPEEDLINK TECHNOLOGY INC., Cupertino, CA (US); HUIZHOU SPEED WIRELESS TECHNOLOGY CO., ITD, Guangdong (CN)

( * ) Notice: Subject to any disclaimer, the term of this patent is extended or adjusted under 35 U.S.C. 154(b) by 35 days.

(21) Appl. No.: 15/729,641

(22) Filed: Oct. 10, 2017

(65) Prior Publication Data

US 2019/0006739 A1 Jan. 3, 2019

(30) Foreign Application Priority Data

Jun. 30, 2017 (CN) ..... 2017 1 0525437

(51) Int. Cl.

| | |
|---|---|
| ***H01Q 1/24*** | (2006.01) |
| ***H01Q 1/50*** | (2006.01) |
| ***H01Q 5/50*** | (2015.01) |
| ***H01Q 9/04*** | (2006.01) |
| ***H01Q 15/14*** | (2006.01) |

(52) U.S. Cl.

CPC ..... *H01Q 1/243* (2013.01); *H01Q 1/50* (2013.01); *H01Q 5/50* (2015.01); *H01Q 9/045* (2013.01); *H01Q 15/14* (2013.01)

(58) Field of Classification Search

CPC ..... H01Q 1/243; H01Q 1/50; H01Q 5/50; H01Q 5/55; H01Q 9/045; H01Q 15/14; H01Q 15/18; H01Q 13/18

See application file for complete search history.

(56) References Cited

U.S. PATENT DOCUMENTS

| | | | | |
|---|---|---|---|---|
| 8,125,394 | B2 * | 2/2012 | Chiang | H01Q 9/30 343/702 |
| 2016/0351996 | A1 * | 12/2016 | Ou | H01Q 1/241 |
| 2017/0201011 | A1 * | 7/2017 | Khripkov | H01Q 1/243 |
| 2018/0062256 | A1 * | 3/2018 | Kim | H01Q 1/243 |

* cited by examiner

*Primary Examiner* — Robert Karacsony

(74) *Attorney, Agent, or Firm* — Womble Bond Dickinson (US) LLP

(57) ABSTRACT

An antenna system applied in the metal back cover of a 5G mobile terminal contains a metal back cover, a feeder line and at least one antenna element. The metal back cover is composed of a bottom case & a frame. The antenna element is composed of a feed screw, a pillar, a insulating sleeve and a reflecting cavity. The reflecting cavity is formed by the inner concave of the outer side of the metal frame. The reflecting cavity includes the first wall and the second wall distributed from bottom to top. The first wall is a part of the bottom case. The first wall, the pillar, the second wall and the feeder line are arranged orderly and are connected with the feed screw. The pillar and the feed screw are connected by screw thread. The feed screw is connected with the second wall through an insulating sleeve.

18 Claims, 12 Drawing Sheets

ANTENNA AND ANTENNA SYSTEM APPLIED IN METAL COVER

RELATED APPLICATIONS

This application claims the priority of Chinese patent application No. 201710525437.0, filed Jun. 30, 2017, which is incorporated by reference in its entirety.

FIELD OF THE DISCLOSURE

This disclosure relates generally to technical field of antennas. More specifically, this disclosure relates to a wide band antenna element with a reflecting cavity and an antenna system.

BACKGROUND

Fifth generation (5G) technology faces the human information society after 2020. The predictable features of 5G technology, such as high data rate, low latency, mass devices connection and low power consumption, will play a very important role in the future society, even though the related technologies are not finalized. As the key component of 5G terminal device, 5G terminal antenna will play an active and important role in promoting the development of the new generation mobile communication system and 5G mobile terminals.

Different from the omnidirectional radiation pattern of 4G mobile terminals, 5G mobile terminals need an antenna array that operates at millimeter wave band to realize beam forming function, but the antenna array at mobile terminals is different from the one of the base station. In base station, several 5G base station antenna demos have been demonstrated due to the less restrictions on antenna size and the support of the relatively mature phased array technology. But in mobile terminals, the coexistence of the 5G antenna and the existing 2G/3G/4G/GPS/WIFI/BT antennas is quite challenging due to the narrow antenna space and complicated metal environment of mobile terminals.

SUMMARY

This disclosure relates generally to an antenna and antenna system applied in metal back cover of 5G mobile terminals, which aims to realize the coexistence of 5G antenna and the existing second generation (2G), third generation (3G), fourth generation (4G), global positioning system (GPS), WiFi, and Bluetooth (BT) antennas.

In order to realize the above purpose, this disclosure provides an antenna system applied in the metal back cover of the 5G mobile terminal, which includes a metal back cover, a feeder line, and at least one antenna element. The metal back cover includes a bottom case and a metal frame. The antenna element is composed of a feed screw, a pillar, an insulating sleeve, and a reflecting cavity. The reflecting cavity is formed by an inner concave of an outer side of the metal frame. The reflecting cavity includes a first wall and a second wall distributed from bottom to top. The first wall is a part of the bottom case. The first wall, the pillar, the second wall, and the feeder line are arranged orderly and are connected with the feed screw. The pillar and the feed screw are connected by screw thread. The feed screw is connected with the second wall through an insulating sleeve. The pillar is a good conductor and an under surface of the pillar contacts with the first wall.

The 5G antenna in this disclosure is located at a side of a mobile terminal, which does not occupy a position of the traditional antennas, so it can coexist with the 2G/3G/4G/GPS/WIFI/BT antennas. The reflecting cavity can change the radiation direction of the 5G antenna, so that the electromagnetic radiation that human suffers can be reduced. For example, it is quite necessary to reduce the radiation on the front of the 5G mobile terminal when the user is on the phone. In addition, if the reflecting cavity is fed directly by the feed screw, the bandwidth of the antenna will be quite narrow due to the big impedance difference between the feed screw and the reflecting cavity. The pillar in the reflecting cavity forms a gradual transition structure between the feed screw and the first wall of the cavity, which can properly improve the impedance bandwidth of the antenna element.

Further, the feed screw includes a screw head and a screw column, and the screw head is located at one end of the feed screw that is close to the first wall. Further, the shape of the reflecting cavity is a cuboid, and the antenna's operating wavelength is $\lambda$ ($\lambda$, is the wavelength of 28 Gigahertz (GHz) in free space), and the length, width, and height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$, respectively. The radiation of unnecessary directions of the 5G antenna can be reduced, which includes the above mentioned reflecting cavity. Further, the shape of the pillar is a combination of a cuboid and a semicolumn. The length, width, and height of the pillar are $\frac{3}{16}\lambda\sim\frac{3}{8}\lambda$, $\frac{1}{8}\lambda\sim\frac{1}{4}\lambda$, and $\frac{1}{15}\lambda\sim\frac{1}{8}\lambda$, respectively. The length of the cuboid equals to the diameter of the semicolumn, and a long side of the pillar parallels to the broadside of the reflecting cavity.

Further, the ratio of the reflecting cavity's length to the pillar's length is 12:5. The ratio of the reflecting cavity's width to the pillar's width is 11:5. The ratio of the reflecting cavity's height to the pillar's height is 3:2. The long side of the pillar parallels to the broadside of the reflecting cavity.

Further, the reflecting cavity can be filled with low loss materials whose permittivity is larger than 1 and its dielectric loss is less than 0.02, such as, for example, plastic. The reflecting cavity can be filled with different materials or filled partially, and the filling method can be used for nano injection molding. The detail filling methods and materials can be selected according to the beam scanning range of the antenna. When the reflecting cavity is filled with plastic materials, the distance between elements can be reduced therefore the scanning angle can be increased. The bandwidth of the antenna will be reduced, the coupling between elements will be increased, and the radiation efficiency of the antenna will be decreased. If it is necessary, the reflecting cavity can be filled with air.

Further, the reflecting cavity and the pillar are connected with each other and are formed by opening a slot on the metal frame through a computer numerical control (CNC) process. Further, the antenna array includes N elements, and N is a positive integer which is larger than 1. Further, the antenna system applied in the metal back cover includes at least two arrays which are arranged respectively at both long sides of the metal back cover. The antenna array does not occupy the position of the traditional antennas, so it can coexist with the 2G/3G/4G/GPS/WIFI/BT antennas. It has a wide bandwidth and a high gain, and can realize wide beam scanning angle and beam width.

Further, this disclosure provides a radio frequency (RF) frontend system with the above mentioned antenna system applied in metal back cover, which is composed of a RF transceiver, a receiving and processing circuit, a transmitting and processing circuit, a speaker, a microphone, and a main processor. Through an architecture which includes a feed screw and a reflecting cavity, this disclosure realizes that the 5G antenna is set at the side of the mobile terminal, therefore the 5G antenna can coexist with the 2G/3G/4G/GPS/WIFI/BT antennas.

DETAILED DESCRIPTION

Figure 1:
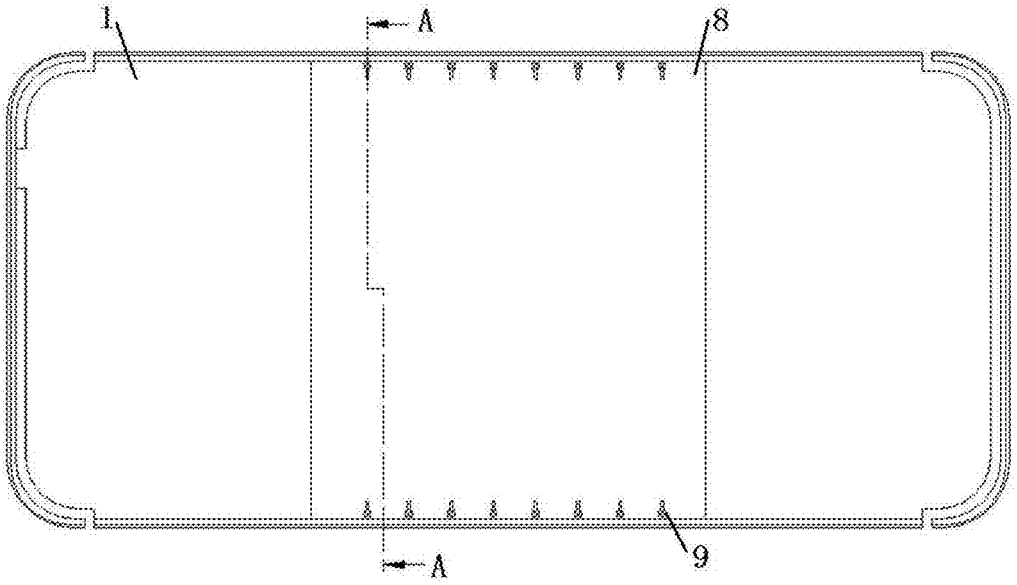
FIG. 1 illustrates an example front view of a 5G mobile terminal in accordance with this disclosure.
Figure 2:
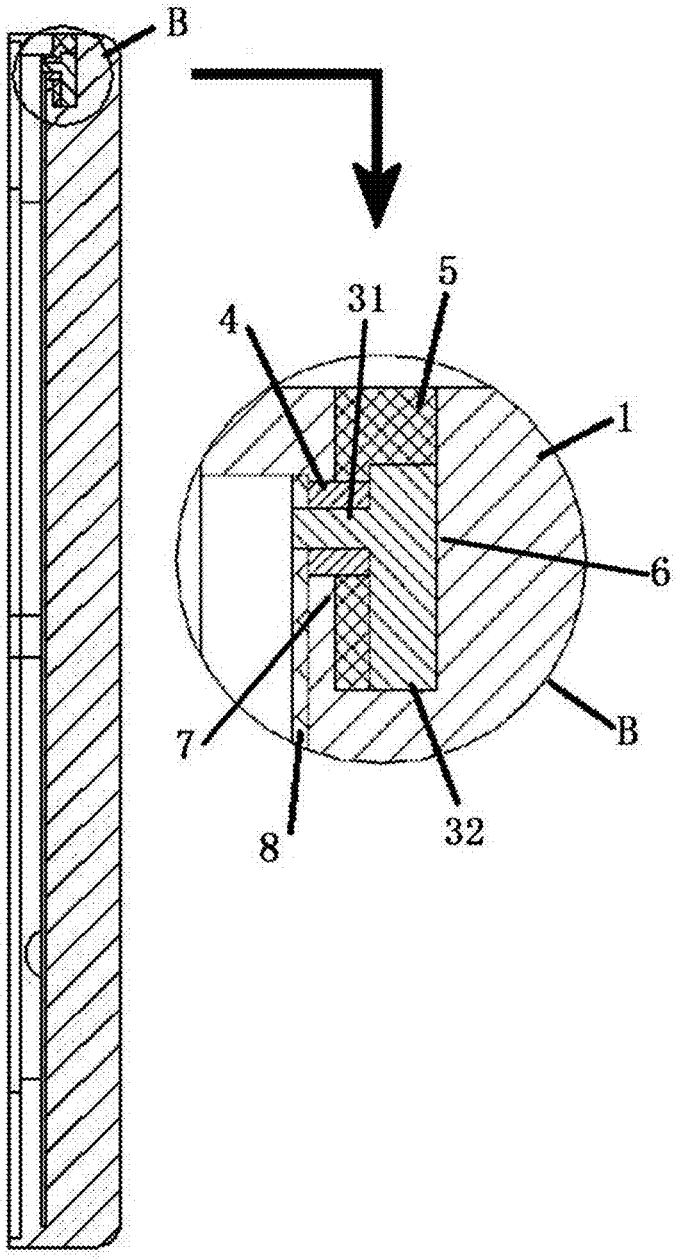
FIG. 2 illustrates an example profile of the antenna element along AA line in FIG. 1 and the enlarged structure schematic of the antenna element in accordance with this disclosure.
Figure 3:
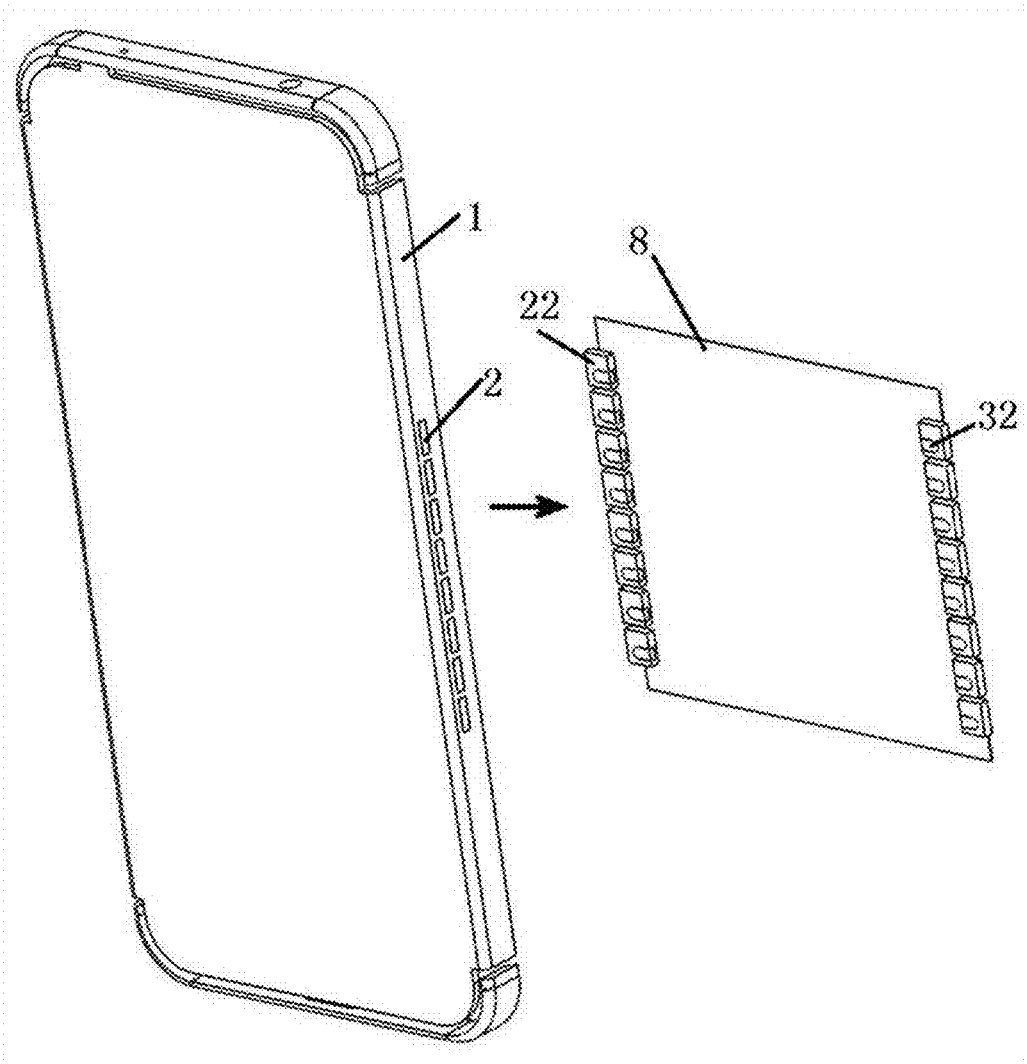
FIG. 3 illustrates an example structure comparison schematic of the antennas with and without the metal back cover in accordance with this disclosure.
Figure 4:
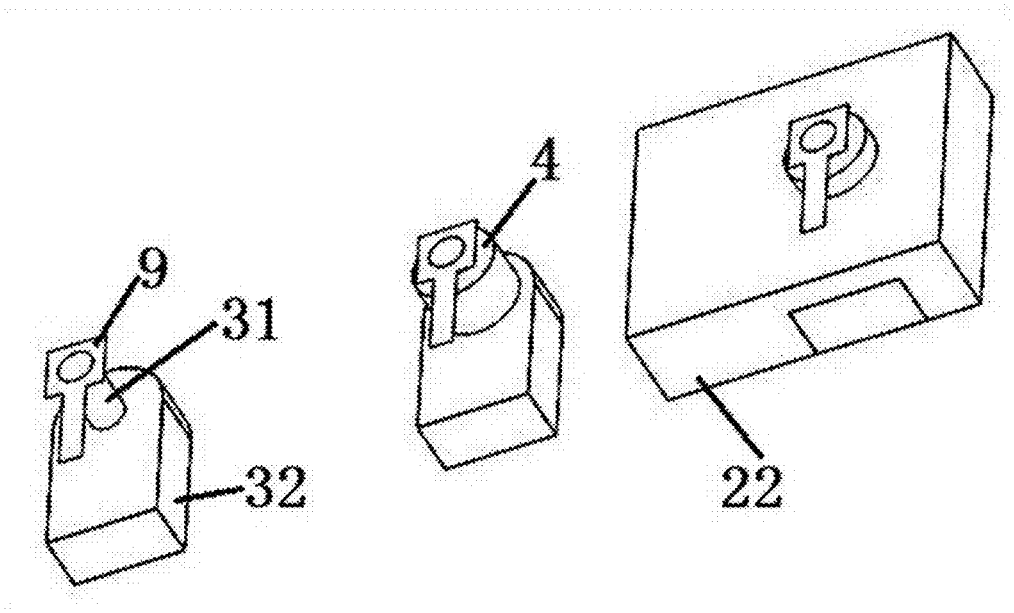
FIG. 4 illustrates an example different structures schematic of the antenna in accordance with this disclosure.
Figure 5:
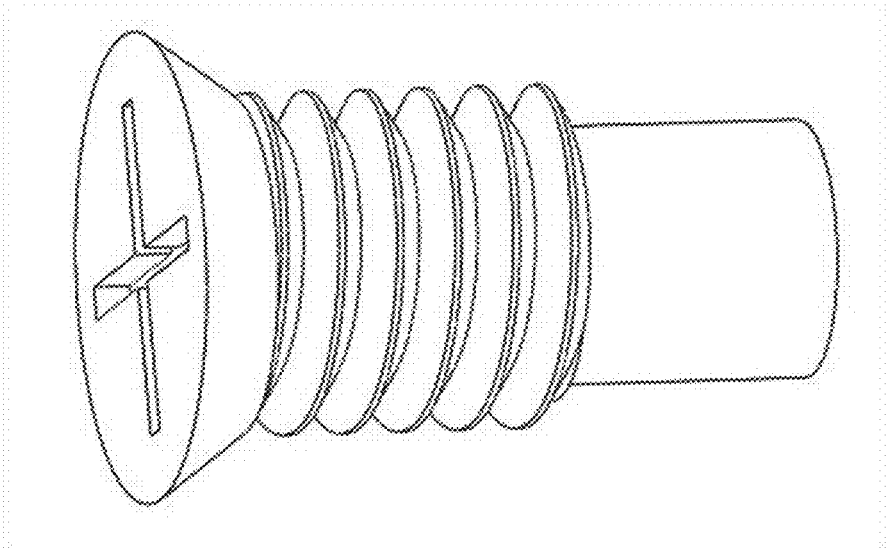
FIG. 5 illustrates an example structure schematic of the feed screw according to embodiment A in this disclosure.

Figures discussed above, and the various embodiments used to describe the principles of the invention in this patent application are by way of illustration only and should not be construed in any way to limit the scope of the invention. Drawings and embodiments are provided so that the invention will be thorough and complete and will fully convey the scope of the invention to those skilled in the art.

Description of appendix mark: 1 denotes metal back cover, 2 denotes antenna element, 31 denotes feed screw, 32 denotes pillar, 4 denotes insulating sleeve, 5 denotes reflecting cavity, 6 denotes the first wall, 7 denotes the second wall, 8 denotes main board of the 5G mobile terminal, 9 denotes feeder line, 11 denotes antenna array, 12 denotes RF transceiver, 13 denotes receiving and processing circuit, 14 denotes transmitting and processing circuit, 15 denotes speaker, 16 denotes microphone, 17 denotes main processor, 18 denotes input and output port, 19 denotes keyboard, 20 denotes screen, 21 denotes memory, 22 denotes low loss materials, **100*a*-100*n* denote antenna elements, 110*a*-110*n* denote receiving and transmitting switches, 120*a*-120*n* denote power amplifiers, 130*a*-130*n* denote low noise amplifiers, 140*a*-140*n* denote low loss switches, 150*a*-150*n* denote phase shifters, 160*a*-160*n*** denote RF signals.

Embodiment A

FIGS. 1 to 5 illustrate an antenna system applied in a metal back cover of a 5G mobile terminal, which includes a metal back cover, a feeder line, and at least one antenna element. The metal back cover includes a bottom case and a metal frame. The antenna element is composed of a feed screw, a pillar, an insulating sleeve, and a reflecting cavity. The reflecting cavity is formed by an inner concave of an outer side of the metal frame. The reflecting cavity includes a first wall and a second wall distributed from bottom to top. The first wall is a part of the bottom case. The first wall, the pillar, the second wall, and the feeder line are arranged orderly and are connected with the feed screw. The pillar and the feed screw are connected by screw thread. The feed screw is connected with the second wall through an insulating sleeve. The pillar is a good conductor and an under surface of the pillar contacts with the first wall. The screw head of the feed screw is near the first wall.

The implementation procedures of this embodiment can be organized as follows: the reflecting cavity and the pillar are formed by opening a slot on the metal frame through a CNC process. The feed screw passes through holes that are drilled in the first wall, the pillar, and the second wall, orderly. Then the insulating sleeve is penetrated through the hole of the second wall and is sheathed on the feed screw. The feed screw passes through the hole in a printed circuit board (PCB) and the hole on the feeder line. Then the feed screw and the feeder line are welded together. Therefore, the first wall of the reflecting cavity and the feeder line are connected by the feed screw, and the above mentioned processes and components constitute a complete feeding structure. The shape of the pillar, the filling materials of the cavity, and the filling methods can be selected according to the requirements of this embodiment.

Embodiment B

Figure 6:
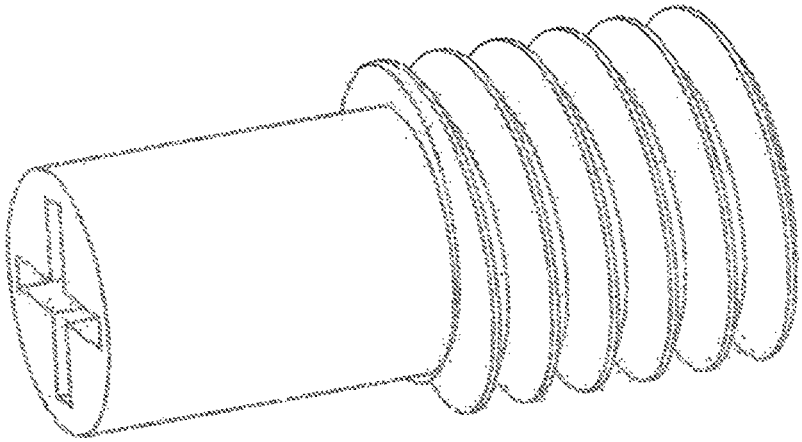
FIG. 6 illustrates an example structure schematic of the feed screw according to embodiment B in this disclosure.

FIGS. 1 to 4 and FIG. 6 illustrate a 5G antenna element that is similar to the one in Embodiment A. The difference is that the head of the feed screw is near the second wall. As illustrated in FIG. 6, the screw thread is set at the opposite side of the screw head. The diameter of the screw head equals to the diameter of the screw column. The screw head with a cross or a linear groove facilitates the screw to be installed into the hole in the pillar. The implementation procedures of this embodiment can be organized as follows: the reflecting cavity and the pillar are formed by opening a slot on the metal frame through a CNC process. The feed screw passes through the holes that are drilled in the second wall and the pillar, orderly. Then the insulating sleeve is penetrated through the hole of the second wall and is sheathed on the feed screw which is connected with the thread of the pillar. The feed screw passes through the hole in the PCB and the hole on the feeder line, and then the feed screw and the feeder line are welded together.

Embodiment C

FIGS. 1 to 6 illustrate a 5G antenna element in this embodiment, which is similar to Embodiment A and Embodiment B. The shape of the reflecting cavity is a cuboid, and the length, width, and height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$, respectively. The length, width, and height of the pillar are $\frac{3}{16}\lambda\sim\frac{3}{8}\lambda$, $\frac{1}{8}\lambda\sim\frac{1}{4}\lambda$, and $\frac{1}{15}\lambda\sim\frac{1}{8}\lambda$ ($\lambda$, is the wavelength of 28 GHz in free space), respectively. The long side of the pillar parallels to the broadside of the reflecting cavity.

The size of the reflecting cavity and the pillar should be set according to the operating wavelength of the antenna element, so that a wide impedance bandwidth and a good directional radiation pattern of the antenna element can be obtained. In this embodiment, through adjusting the position and size of the reflecting cavity and the pillar, the antenna element can achieve a wide impedance bandwidth and the radiation on the front of the mobile terminal can be reduced greatly.

Embodiment D

FIGS. 1 to 6 illustrate the 5G antenna element in this embodiment, which is similar to Embodiment A and Embodiment B. The ratio of the reflecting cavity's length to the pillar's length is 12:5. The ratio of the reflecting cavity's width to the pillar's width is 11:5. The ratio of the reflecting cavity's height to the pillar's height is 3:2. The length, width, and height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$ ($\lambda$, is the wavelength of 28 GHz in free space), respectively. The long side of the pillar parallels to the broadside of the reflecting cavity.

The size of the reflecting cavity and the pillar should be set according to the operating wavelength of the antenna element, so that a wide impedance bandwidth and a good directional radiation pattern of the antenna element can be obtained. In this embodiment, several shapes and sizes of the pillar are simulated and tested based on the above mentioned size of the reflecting cavity, and the pillar that meets the above mentioned ratio can achieve the best radiation performance.

Embodiment E

As illustrated in FIGS. 1 to 13, this embodiment is similar to Embodiment C, 16 antenna elements are disposed on the metal back cover of a 5G mobile terminal, and each antenna array has 8 antenna elements, which is located at both long sides of the metal back cover.

Figure 7:
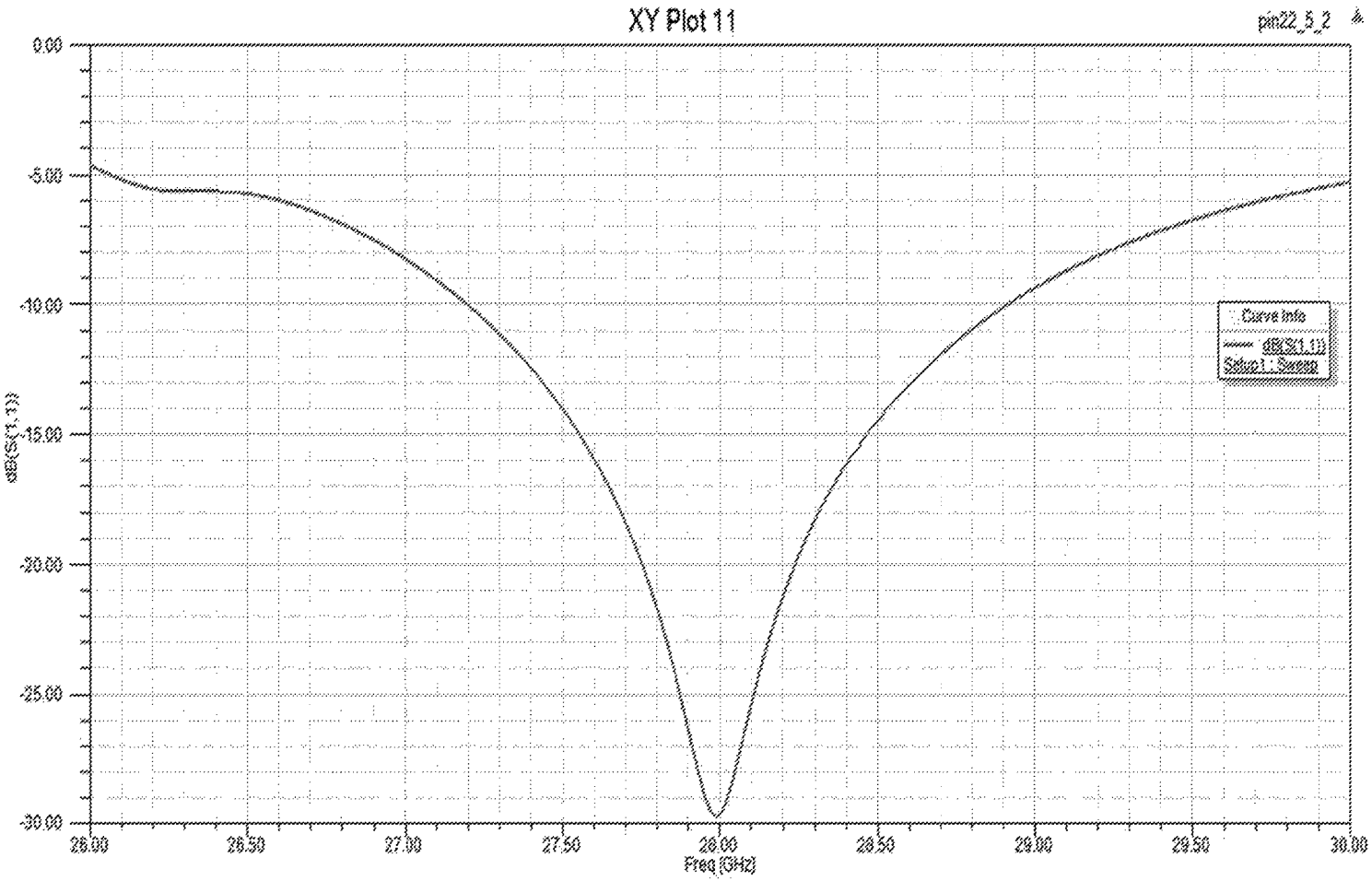
FIG. 7 illustrates an example reflection coefficient curve diagram of an antenna element operating at 26-30 GHz in accordance with this disclosure.
Figure 8:
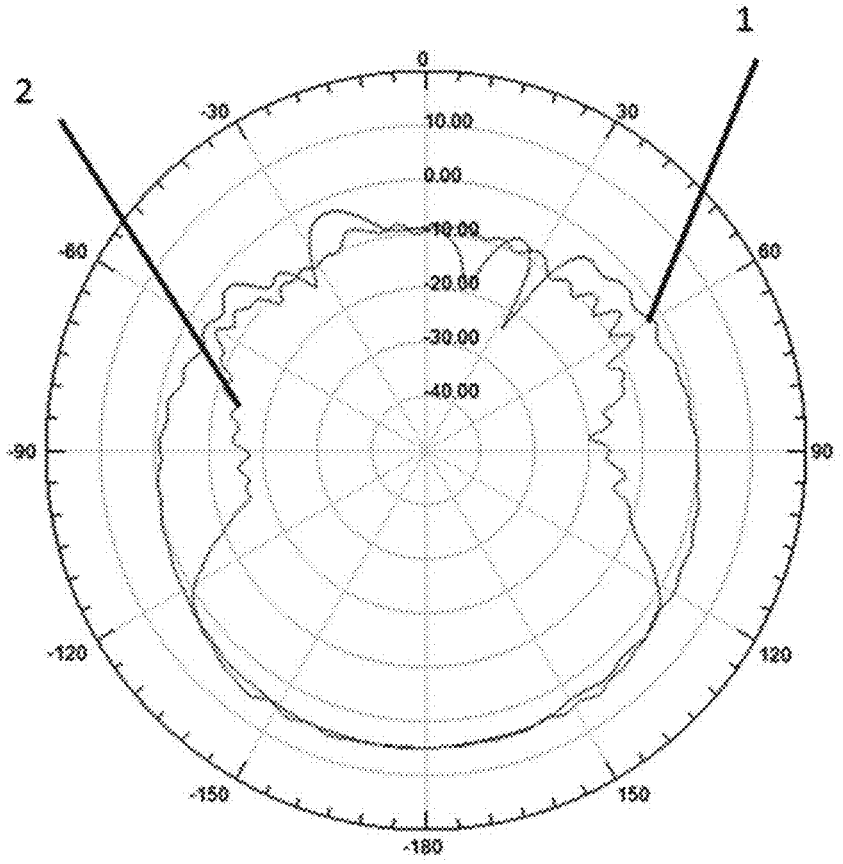
FIG. 8 illustrates an example radiation pattern of an antenna element operating at 28 GHz in accordance with this disclosure.

FIG. 7 illustrates a reflection coefficient curve diagram of the antenna element operating at 26-30 GHz. FIG. 8 illustrates a two-dimensional (2D) radiation pattern of the antenna element operating at 28 GHz, and curve 1 denotes the radiation pattern of the vertical section, and curve 2 denotes the radiation pattern of the horizontal section.

Figure 9:
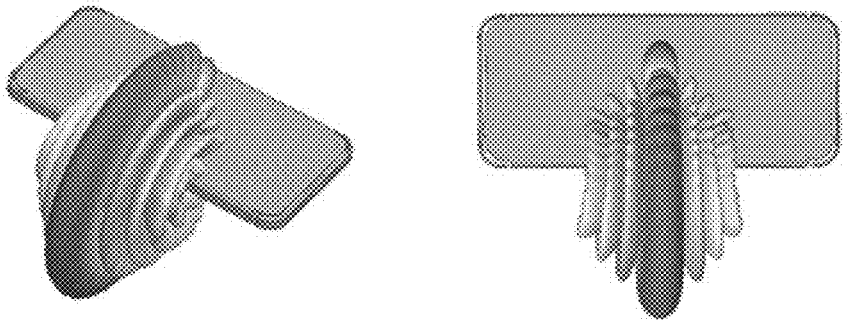
FIG. 9 illustrates an example three-dimensional (3D) radiation pattern of the antenna array with 0 degree phase difference between each element in accordance with this disclosure.
Figure 10:
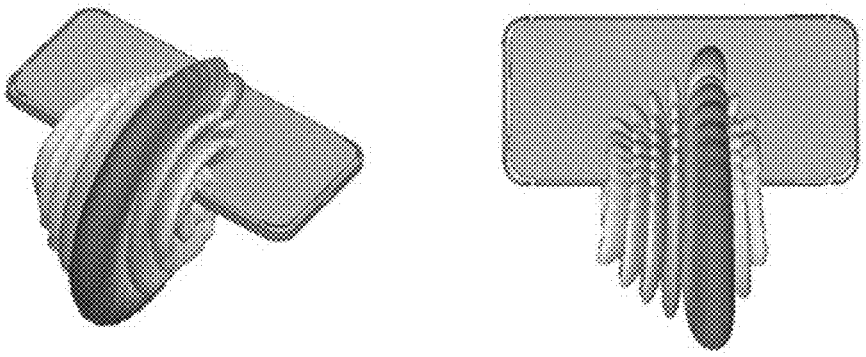
FIG. 10 illustrates an example 3D radiation pattern of the antenna array with 45 degree phase difference between each element in accordance with this disclosure.
Figure 11:
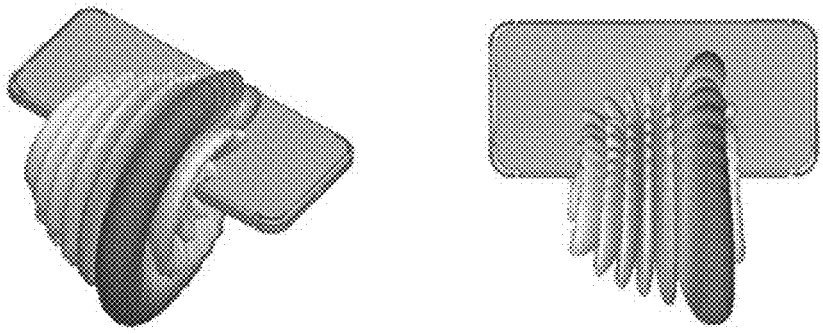
FIG. 11 illustrates an example 3D radiation pattern of the antenna array with 90 degree phase difference between each element in accordance with this disclosure.
Figure 12:
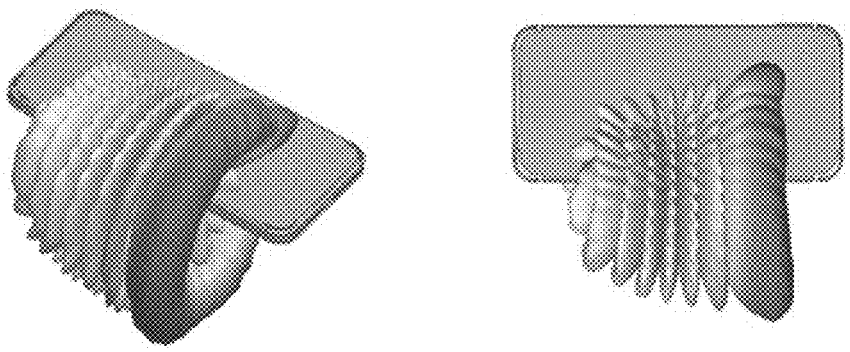
FIG. 12 illustrates an example 3D radiation pattern of the antenna array with 135 degree phase difference between each element in accordance with this disclosure.
Figure 13:
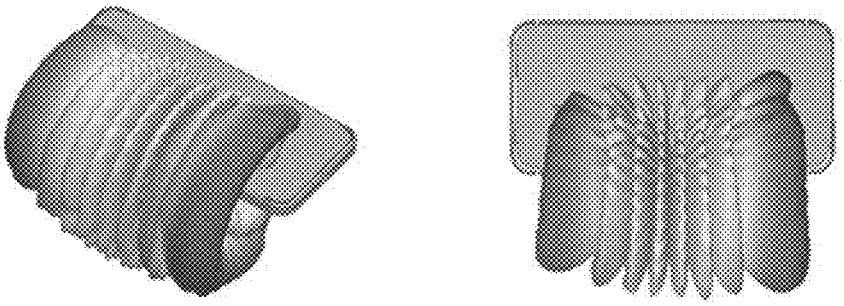
FIG. 13 illustrates an example 3D radiation pattern of the antenna array with 170 degree phase difference between each element in accordance with this disclosure.

FIGS. 9 to 13 illustrate radiation patterns of an eight antenna elements array. The phase differences between the adjacent antenna elements are 0 degree, 45 degree, 90 degree, 135 degree, and 170 degree, respectively. As illustrated in FIG. 9, a radiation direction is 0 degree when the phase difference between the adjacent antenna elements is 0 degree. As illustrated in FIG. 10, the radiation direction tilts 13 degree when the phase difference between the adjacent antenna elements is 45 degree. As illustrated in FIG. 11, the radiation direction tilts 26 degree when the phase difference between the adjacent antenna elements is 90 degree. As illustrated in FIG. 12, the radiation direction tilts 37 degree when the phase difference between the adjacent antenna elements is 135 degree. As illustrated in FIG. 13, the radiation direction tilts 51 degree when the phase difference between the adjacent antenna elements is 170 degree.

Embodiment E describes a beam scanning pattern of two 8 antenna elements array that is integrated on the metal back cover of the 5G mobile terminal, and its scanning angle is from −51 degree to 51 degree.

Embodiment F

Figure 14:
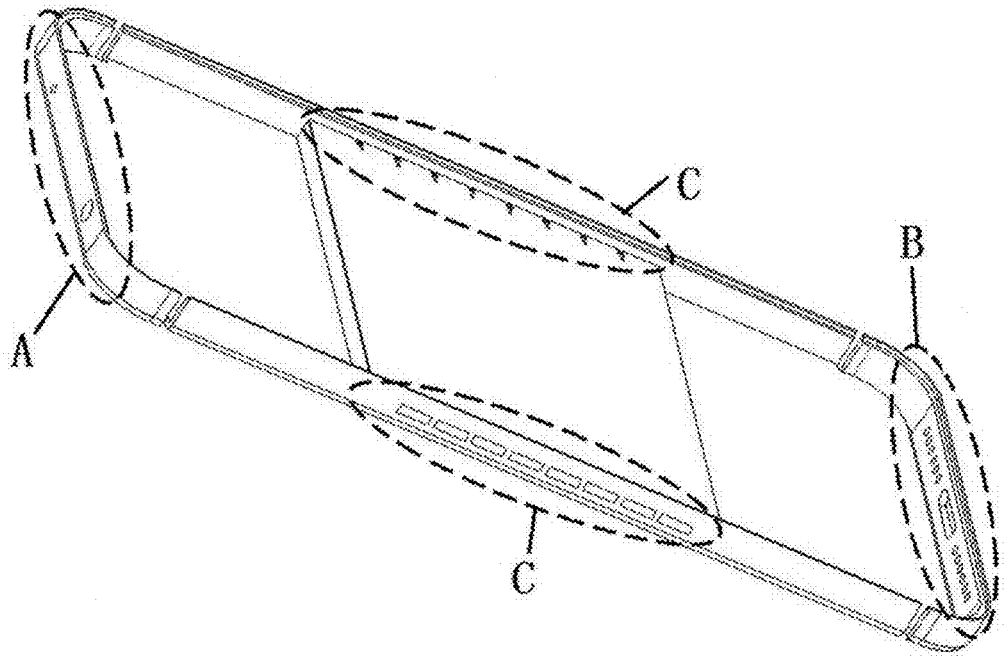
FIG. 14 illustrates an example positions schematic of the antennas on the metal back cover in accordance with this disclosure.

As illustrated in FIG. 14, the 5G antenna in this embodiment is similar to Embodiment A to Embodiment E. Zone A is the position of a long term evolution (LTE) diversity antenna, GPS/WIFI/BT antennas, and zone B is the position of the LTE main antenna, and zone C is the position of the 5G antenna.

Embodiment G

Figure 15:
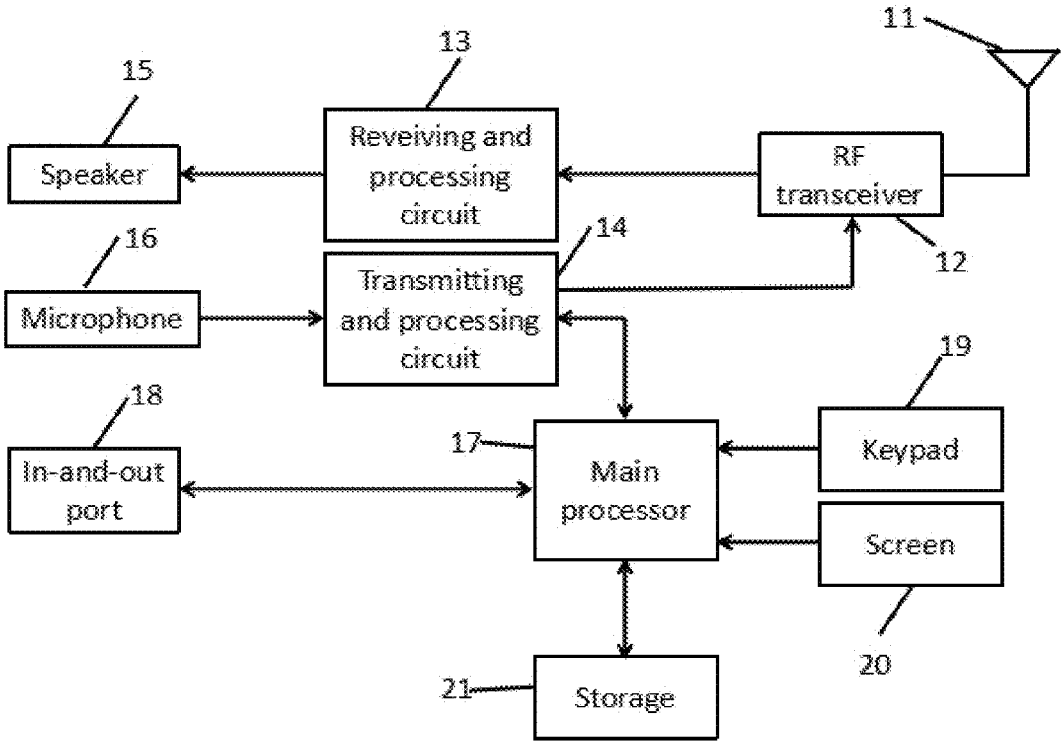
FIG. 15 illustrates an example system structure schematic of a 5G mobile terminal in accordance with this disclosure.

As illustrated in FIG. 15, this disclosure provides a 5G mobile terminal system structure with the above mentioned antenna systems, which includes an antenna array 11, a RF frontend module 12, a base band receiving processing circuit 13, a base band transmitting processing circuit 14, a speaker 15, a microphone 16, a main processor 17, an input and output port 18, a keyboard 19, a screen 20, and a memory 21. The RF frontend module receives an RF signal from the base stations through the antenna array and produces an intermediate frequency (IF) signal and a baseband signal through a down conversion module. The baseband signal is filtered and decoded via a receiver (RX) circuit 13, and the above processed signal is transmitted to the speaker 15 or the main processor 17 for further processing. The RX circuit 14 receives a voice signal from microphone 16 and the baseband signal from the main processor 17. After digital processed in transmitter (TX) circuit 14, the baseband signal will be up-converted to be an RF signal which can be transmitted by the antenna array 11.

Embodiment H

Figure 16:
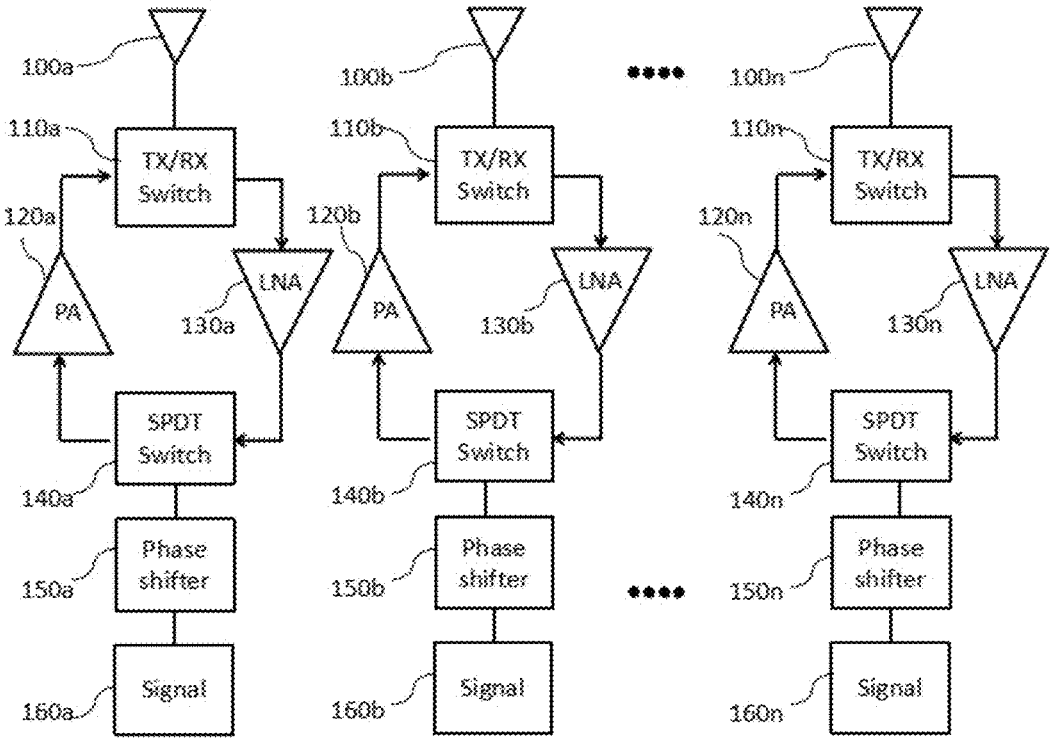
FIG. 16 illustrates an example system structure schematic of an RF frontend system in accordance with this disclosure.

As illustrated in FIG. 16, this embodiment is similar to embodiment G of this disclosure. An RF frontend transceiver module described in this embodiment can realize the beam scanning function described in Embodiment D. As shown in FIG. 16, it includes antenna elements 100*a* to 100*n*, T/R switches 110*a* to 110*n*, power amplifiers 120*a* to 120*n* of the transmitter, low noise amplifiers 130*a* to 130*n* of the receiver, low noise switches 140*a* to 140*n*, phase shifters 150*a* to 150*n*, and RF signals 160*a* to 160*n*. The transceiver switches 110*a* to 110*n* and the low loss switches 140*a* to 140*n* can control whether the antenna elements 110*a* to 110*n* in the system are to receive signals or transmit signals. When RF signals is controlled to be transmitted, the RF signals 160*a* to 160*n* have different phase information for each link through the phase shifters 150*a* to 150*n*. Then the RF signals are amplified by the power amplifiers 120*a* to 120*n*, which consists of a pre-power amplifier and a power amplifier. Finally the RF signals are transmitted to the antenna elements 100*a* to 100*n*. With different phases of the antenna elements, antenna array can form different beam directions, so that an optimum beam pointing can be achieved in real time.

Obviously, the above embodiments of the present invention are merely for the purpose of clearly stating examples of the invention rather than the limitation of the embodiments of the present invention. As for those skilled in the art in the field, there may be other variations or variations on the basis of the foregoing instructions. There is no need to be exhaustive of all implementations. Any modifications, equivalents, substitutions and improvements made within the spirit and principles of the present invention shall be included in the scope of protection of the claims of the present invention. Several embodiments of the present innovation have been described thus far, but the present innovation is not limited to these embodiments.

What is claimed is:

1. An antenna system applied in a metal back cover of a 5G mobile terminal, comprising:

a metal back cover having a bottom case and a metal frame, a feeder line; and at least one antenna element, wherein the at least one antenna element is composed of a feed screw, a pillar, an insulating sleeve and a reflecting cavity, wherein the reflecting cavity is formed by an inner concave of an outer side of the metal frame, wherein the reflecting cavity includes a first wall and a second wall distributed from bottom to top, wherein the first wall is a part of the bottom case, wherein the first wall, the pillar, the second wall, and the feeder line are arranged orderly and are connected with a feed screw, wherein the pillar and the feed screw are connected by a screw thread, wherein the feed screw is connected with the second wall through the insulating sleeve, wherein the pillar is a good conductor and its under surface contacts with the first wall.

2. The antenna element applied in the metal back cover of claim 1, wherein the feed screw includes a screw head and a screw column, and wherein the screw head is located at one end of the feed screw that is close to the first wall.

3. The antenna element applied in the metal back cover of claim 1, wherein a shape of the reflecting cavity is a cuboid and the antenna's operating wavelength is λ, the λ representing a wavelength of 28 GHz in free space, and wherein a length, a width, and a height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$, respectively.

4. The antenna element applied in the metal back cover of claim 3, wherein a shape of the pillar is a combination of a cuboid and a semicolumn, wherein a length, a width, and a height of the pillar are $\frac{3}{16}\lambda\sim\frac{3}{8}\lambda$, $\frac{1}{8}\lambda\sim\frac{1}{4}\lambda$, and $\frac{1}{15}\lambda\sim\frac{1}{8}\lambda$, respectively, and wherein a length of the cuboid equals to a diameter of the semicolumn, and a long side of the pillar parallels to a broadside of the reflecting cavity.

5. The antenna element applied in the metal back cover of claim 1, wherein a ratio of the reflecting cavity's length to the pillar's length is 12:5, wherein a ratio of the reflecting cavity's width to the pillar's width is 11:5, wherein a ratio of the reflecting cavity's height to the pillar's height is 3:2, and wherein a long side of the pillar parallels to a broadside of the reflecting cavity.

6. The antenna element applied in the metal back cover of claim 1, wherein the reflecting cavity can be filled with low loss materials.

7. The antenna element applied in the metal back cover of claim 1, wherein the reflecting cavity and the pillar are connected with each other and are formed by opening a slot on the metal frame through a CNC process.

8. The antenna element applied in the metal back cover of claim 1, wherein the antenna array includes N elements, and N is a positive integer which is larger than 1.

9. The antenna element applied in the metal back cover of claim 1, wherein the antenna system applied in the metal back cover includes at least two arrays which are arranged respectively at both long sides of the metal back cover.

10. An RF frontend system comprising:

an RF transceiver, a receiving and processing circuit, a transmitting and processing circuit, a speaker, a microphone, and a main processor, which are enclosed by a metal back cover having a bottom case and a metal frame; and an antenna attached to the metal back cover, the antenna includes a feeder line, and at least one antenna element, wherein the at least one antenna element is composed of a feed screw, a pillar, an insulating sleeve and a reflecting cavity, wherein the reflecting cavity is formed by an inner concave of an outer side of the metal frame, wherein the reflecting cavity includes a first wall and a second wall distributed from bottom to top, wherein the first wall is a part of the bottom case, wherein the first wall, the pillar, the second wall, and the feeder line are arranged orderly and are connected with a feed screw, wherein the pillar and the feed screw are connected by a screw thread, wherein the feed screw is connected with the second wall through the insulating sleeve, wherein the pillar is a good conductor and its under surface contacts with the first wall.

11. The RF frontend system of claim 10, wherein the feed screw includes a screw head and a screw column, and wherein the screw head is located at one end of the feed screw that is close to the first wall.

12. The RF frontend system of claim 10, wherein a shape of the reflecting cavity is a cuboid and the antenna's operating wavelength is λ, the λ representing a wavelength of 28 GHz in free space, and wherein a length, a width, and a height of the reflecting cavity are $\frac{1}{2}\lambda\sim\lambda$, $\frac{1}{10}\lambda\sim\frac{1}{2}\lambda$, and $\frac{1}{8}\lambda\sim\frac{1}{2}\lambda$, respectively.

13. The RF frontend system of claim 12, wherein a shape of the pillar is a combination of a cuboid and a semicolumn, wherein a length, a width, and a height of the pillar are $\frac{3}{16}\lambda\sim\frac{3}{8}\lambda$, $\frac{1}{8}\lambda\sim\frac{1}{4}\lambda$, and $\frac{1}{15}\lambda\sim\frac{1}{8}\lambda$, respectively, and wherein a length of the cuboid equals to a diameter of the semicolumn, and a long side of the pillar parallels to a broadside of the reflecting cavity.

14. The RF frontend system of claim 10, wherein a ratio of the reflecting cavity's length to the pillar's length is 12:5, wherein a ratio of the reflecting cavity's width to the pillar's width is 11:5, wherein a ratio of the reflecting cavity's height to the pillar's height is 3:2, and wherein a long side of the pillar parallels to a broadside of the reflecting cavity.

15. The RF frontend system of claim 10, wherein the reflecting cavity can be filled with low loss materials.

16. The RF frontend system of claim 10, wherein the reflecting cavity and the pillar are connected with each other and are formed by opening a slot on the metal frame through a CNC process.

17. The RF frontend system of claim 10, wherein the antenna array includes N elements, and N is a positive integer which is larger than 1.

18. The RF frontend system of claim 10, wherein the antenna system applied in the metal back cover includes at least two arrays which are arranged respectively at both long sides of the metal back cover.

* * * * *